United States Patent [19]

Rudy, Jr. et al.

[11] Patent Number: 4,864,719

[45] Date of Patent: Sep. 12, 1989

[54] TOOL FOR REMOVING ELECTRICAL CONTACTS

[75] Inventors: William J. Rudy, Jr., Annville; Howard R. Shaffer, Millersburg; Daniel E. Sttahl, Dauphin, all of Pa.

[73] Assignee: AMP Incorporated, Harrisburg, Pa.

[21] Appl. No.: 329,124

[22] Filed: Mar. 27, 1989

Related U.S. Application Data

[62] Division of Ser. No. 180,738, Apr. 8, 1988, which is a division of Ser. No. 42,205, Apr. 24, 1987, Pat. No. 4,762,507.

[51] Int. Cl.[4] ..... H01R 43/00

[52] U.S. Cl. ..... 29/764; 29/278

[58] Field of Search ..... 29/764, 747, 748, 758, 29/235, 278, 825

[56] References Cited

U.S. PATENT DOCUMENTS

| | | | |
|---|---|---|---|
| 3,087,235 | 4/1983 | Porter | 29/764 |
| 3,210,832 | 10/1965 | Kalen . | |
| 3,222,766 | 12/1965 | Camargo | 29/764 |
| 3,224,082 | 12/1965 | Moulin | 29/764 |
| 3,255,427 | 6/1966 | Yeiser . | |
| 3,380,141 | 4/1968 | Rofer | 29/764 |
| 3,638,165 | 1/1972 | Anhalt et al. . | |
| 3,641,477 | 2/1972 | Plana . | |
| 3,747,047 | 7/1973 | Carter et al. . | |
| 3,844,013 | 10/1974 | Hall, Jr. . | |
| 4,035,047 | 7/1977 | Ammon . | |
| 4,070,755 | 1/1978 | Carter . | |
| 4,168,569 | 9/1979 | Fairbairn | 29/764 |
| 4,174,144 | 11/1979 | Le Helloco . | |
| 4,425,704 | 1/1984 | Cline | 29/764 |
| 4,636,020 | 1/1987 | Marmillion . | |

FOREIGN PATENT DOCUMENTS 1281009 12/1972 United Kingdom .

*Primary Examiner*—Carl E. Hall

*Attorney, Agent, or Firm*—Anton P. Ness

[57] ABSTRACT

A system of removably retaining a terminal (16) within a housing passageway (40) includes opposing resilient walls (46A,46B) defining a forward end of the passageway (40) with opposing stop projections (54) extending toward each other and disposed in corresponding notches (26) along first and third sides of the terminal (16), which stop axially rearward terminal movement. A bored shaft (98) of a removal tool (70) is placed over a contact section (18) of the terminal (16) extending outwardly from the housing (12) which tool (70) has a pair of triangular tines (100) at the work end of the tool shaft (98) to be disposed along second and fourth sides of the terminal (16). When the tines (100) are positioned between the walls (46A,46B) and the tool (70) is urged against the housing (12) the tapered side surfaces (104A, 104B), of the tines (100)bear against portions of opposing walls (46Ar,46B) adjacent second and fourth terminal sides, locally deflecting outwardly the walls (46A,46B) and their stop projections (54) away from the terminal's first and third sides, whereafter the terminal (16) is now axially movable along the passageway (40) such as by a plunger of the tool (70) for removal.

3 Claims, 11 Drawing Sheets

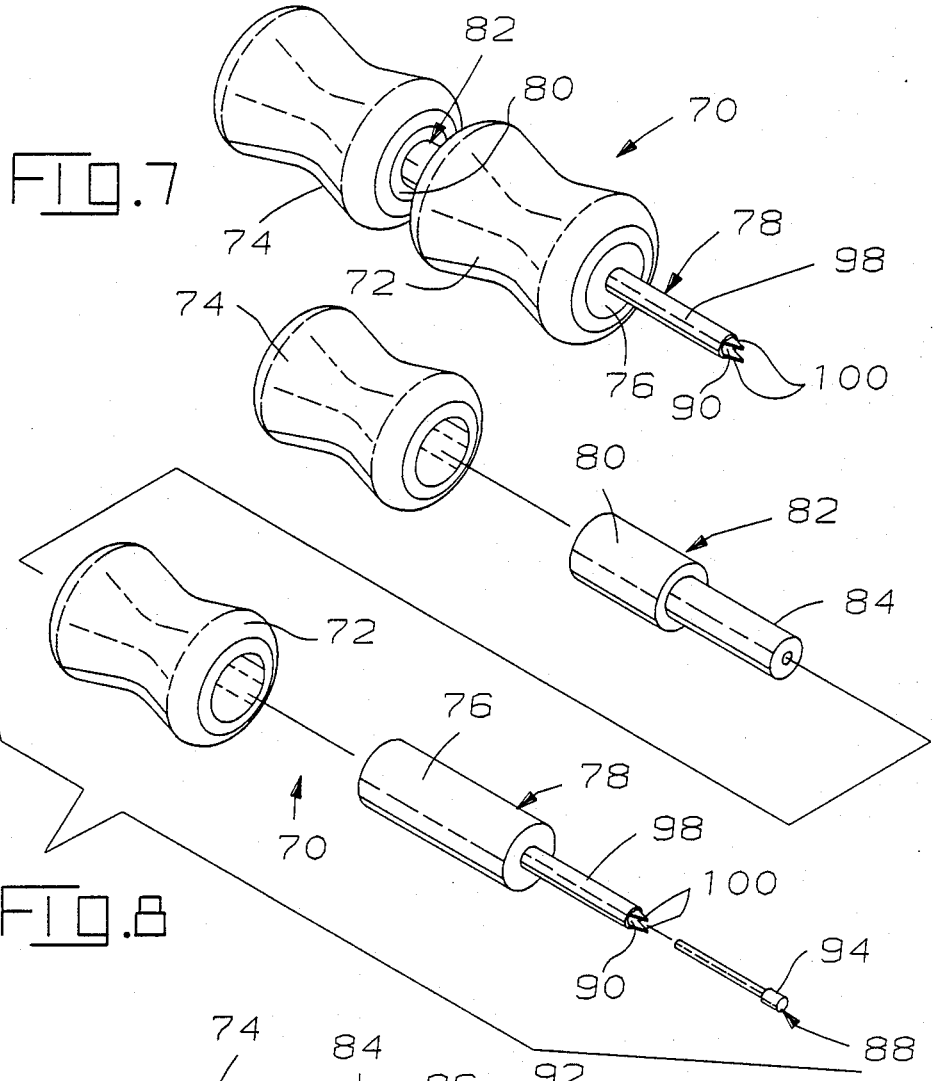
FIG. 7
FIG. 8
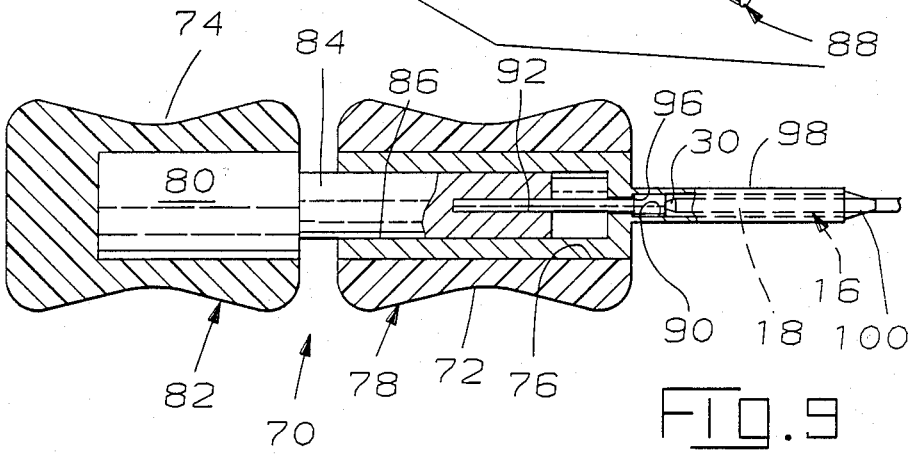
FIG. 9

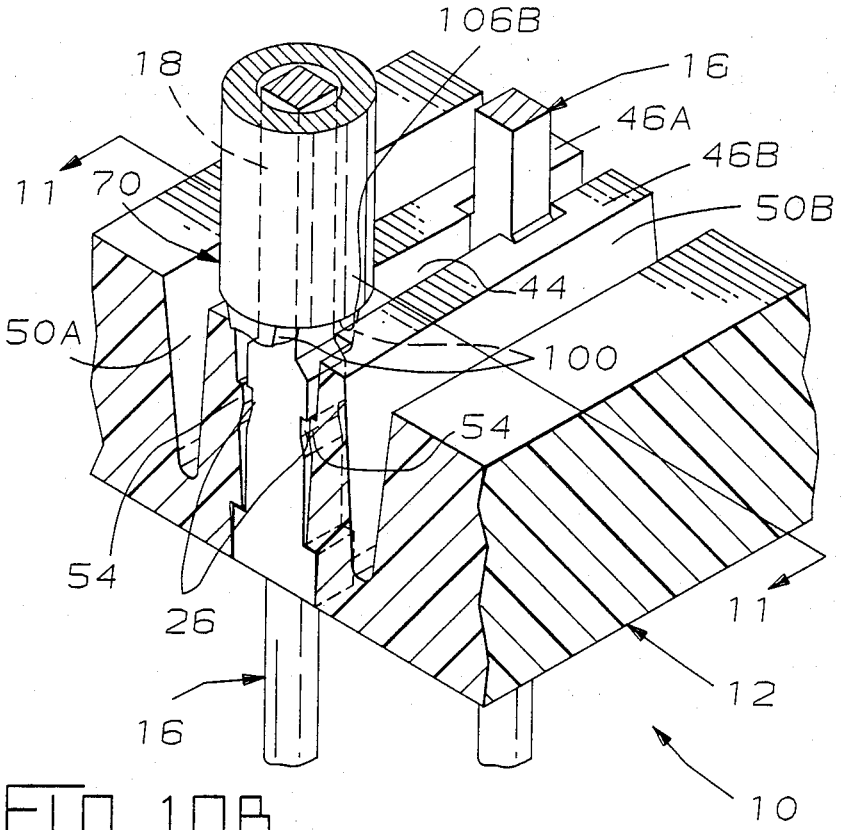
FIG. 10B
FIG. 11
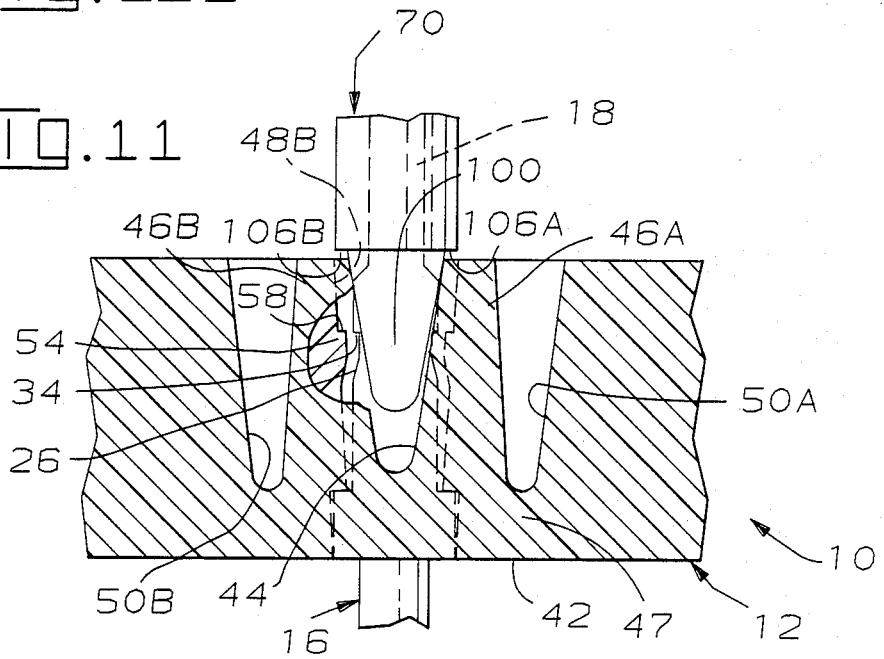

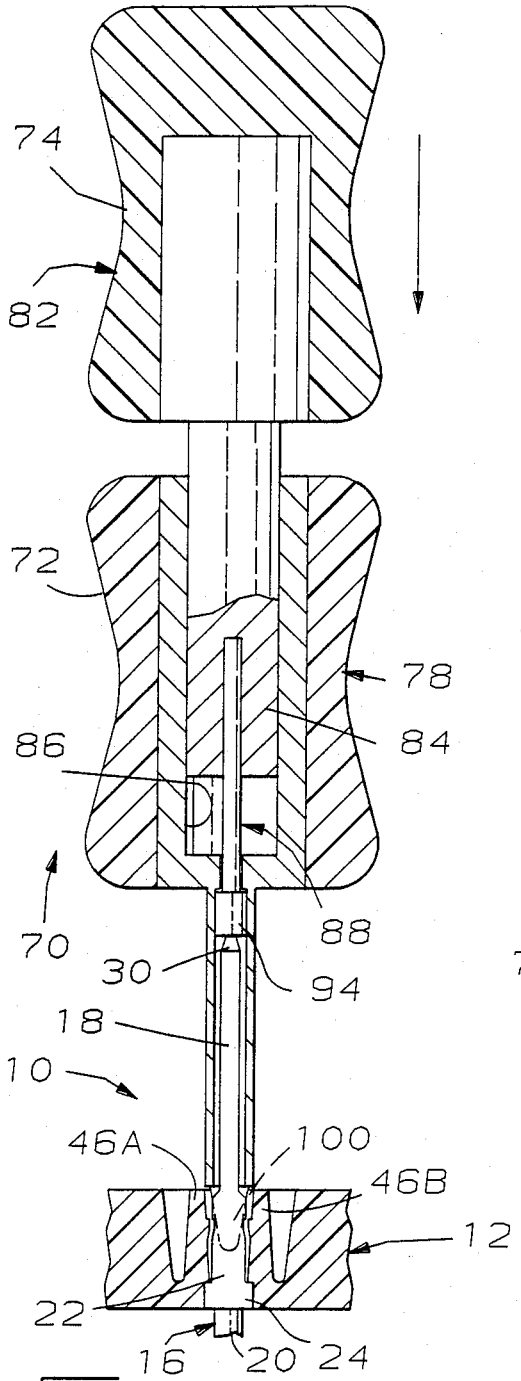
FIG. 12A
FIG. 12B
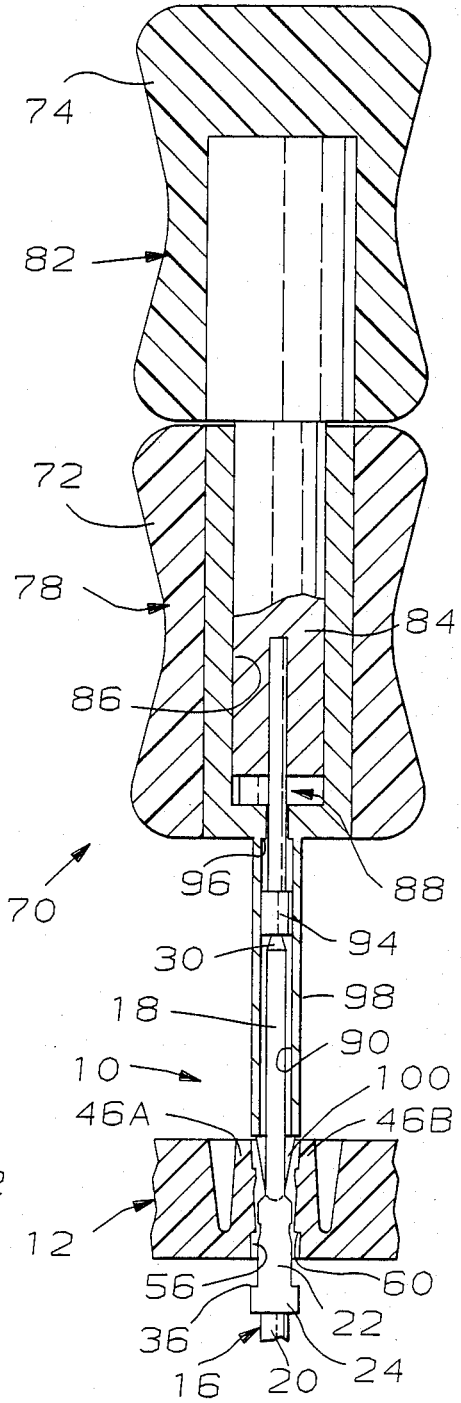

TOOL FOR REMOVING ELECTRICAL CONTACTS

REFERENCE TO RELATED APPLICATIONS

The present application is a Divisional Application of U.S. patent application Ser. No. 07/180,738 filed Apr. 8, 1988 which was a Divisional Application of U.S. patent application Ser. No. 07/042,205 filed Apr. 24, 1987, now U.S. Pat. No. 4,762,507.

FIELD OF THE INVENTION

This relates to the field of electrical connectors and more particularly to the retention of terminals in connector housings.

BACKGROUND OF THE INVENTION

Electrical contact terminals are retained in connector housings in a variety of conventional ways. Certain methods involve molding the housing around the terminals, or potting the terminals within the housing or force fitting the terminals in individual passageways for permanent retention. For retention to permit removal of a terminal, conventional methods include forming locking fingers on a stamped and formed terminal which extend at an appropriate angle laterally to engage behind stop surfaces along the housing passageway to secure the terminal against withdrawal, but are deflectable toward the terminal, and away from the stop surfaces by a tool inserted into the passageway alongside the terminal whereafter the terminal is withdrawn such as for repair or replacement. Another conventional method involves locking fingers of the plastic housing extending into the passageway which are initially deflected by the terminal during insertion and which latch behind an annular collar or stop surface of the terminal upon full insertion, and these fingers are also tool-deflectable for terminal removal. A variety of retention clips are also known, mostly cylindrical metal sleeves which are stamped and formed to have locking fingers which engage an annular collar of a terminal and which are retained in the housing passageway such as by locking lances, and where the locking fingers are deflectable outwardly away from the terminal collar by a tool inserted into the passageway for this purpose, allowing the terminal to be pulled out.

It is desirable to provide a system for securely retaining a terminal in a housing passageway without retention clips or terminal locking fingers, which also permits removal of the terminal when desired.

It is also desirable to provide a one-piece housing which retains a plurality of terminals having an array of aligned contact sections extending therefrom, any one of which may be removed if desired without affecting others of the terminals.

It is further desirable to provide for assured retention of a terminal along a short axial length which also maintains the terminal in axial alignment.

SUMMARY OF THE INVENTION

A contact retention system comprises a terminal having opposed notches proximate the base of a forward contact section such as a wire wrap post cooperable with associated opposed stop projections along a terminal-receiving passageway of the housing to stop axial movement in the direction away from the forward contact section. The plurality of terminal-receiving passageways of the connector housing are disposed in rows and extend to a forward or wire wrap face of the housing from an opposed rearward or mating face. Along the wire wrap face the passageways of each row are intersected by a deep narrow continuous channel which is defined by continuous narrow resilient walls with vertical recess portions therealong defining passageway portions and within which the top projections are disposed. The narrow walls are separated from adjacent walls defining the respective deep narrow channel of the adjacent row of passageways, by additional deep narrow continuous recesses parallel to the channel. The housing being molded of resilient plastic resin, the continuous narrow walls are locally deflectable laterally outwardly into the adjacent recesses by the terminal at a selected terminal location during terminal insertion from the mating face until the stop projections enter the terminal notches. For terminal removal the walls also are locally deflectable thereat outwardly from the channel into the adjacent recesses parallel thereto by an appropriate tool, so that the top projections for that terminal are correspondingly deflected away from the terminal, permitting the terminal to be moved axially in a direction away from the wire wrap post. Each terminal includes opposed stop shoulders proximate the base of the contact section at the opposite end, which engage stop surfaces of the respective passageway upon insertion of the terminal from the mating face during assembly to provide a stop in the direction toward the wire wrap post.

The present invention comprises a tool for use with the present contact retention system, for enabling removal of a selected terminal. The work end of the tool includes a pair of tines spaced apart to straddle the wire wrap post of the terminal and enter the deep channel beside both sides of the post. The tines each have wall-engaging surfaces which are tapered outwardly at a slightly greater angle than the slope of the walls, to engage the wall surfaces adjacent the passageway recess portions when the tool is almost fully inserted, and to then locally deflect the resilient walls outwardly into adjacent recesses when the tool is fully inserted. The tool can include a plunger which urges the terminal downwardly for a distance into the housing when the walls are deflected and the stop projections are dislodged from the notches, whereafter the terminal can be fully withdrawn via the mating face.

It is an objective of the present invention to provide a contact terminal retention system which requires only a one-piece housing and the terminals without retention clips nor other parts or materials for assembly.

It is another objective to provide such a retention system which allows field removal and replacement of a terminal from an array of such terminals.

BRIEF DESCRIPTION OF THE DRAWINGS

FIGS. 7, 8 and 9 are perspective, exploded and longitudinal section views of a removal tool of the present invention.

FIGS. 10A and 10B are enlarged part section views sequentially demonstrating the insertion of the tool of FIG. 7 and release of a terminal.

FIG. 11 is an enlarged section view taken along lines 11—11 of FIG. 10B, showing the tool deflecting the walls of the housing beside a terminal (in phantom).

FIGS. 12A and 12B are diagrammatic section views of the tool after insertion showing actuation of the plunger to release the terminal from the housing.

DETAILED DESCRIPTION OF THE PREFERRED EMBODIMENT

Figure 1:
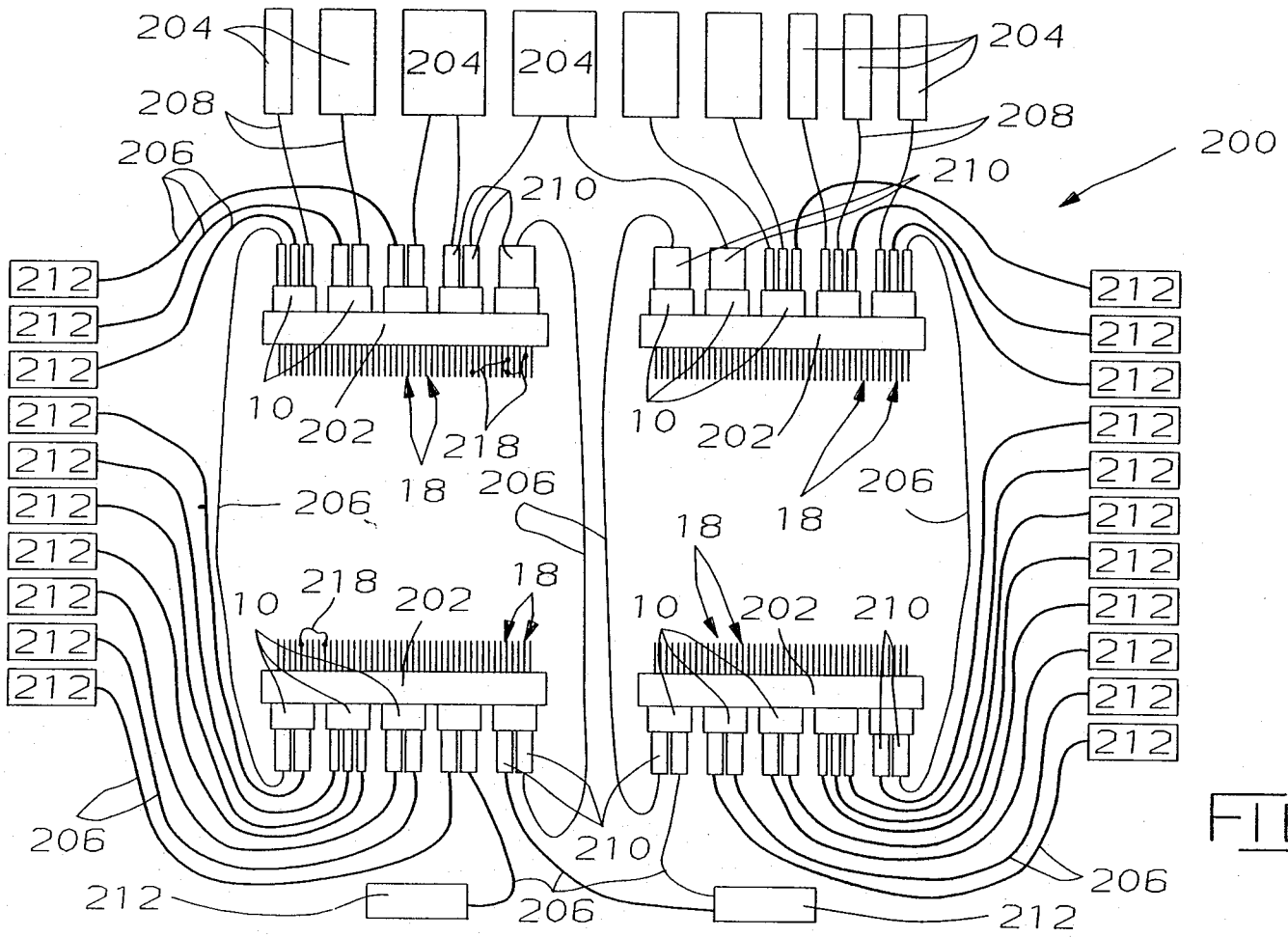
FIG. 1 and 2 are schematic and perspective views of a wire integration system with which the present invention may be used.
Figure 2:
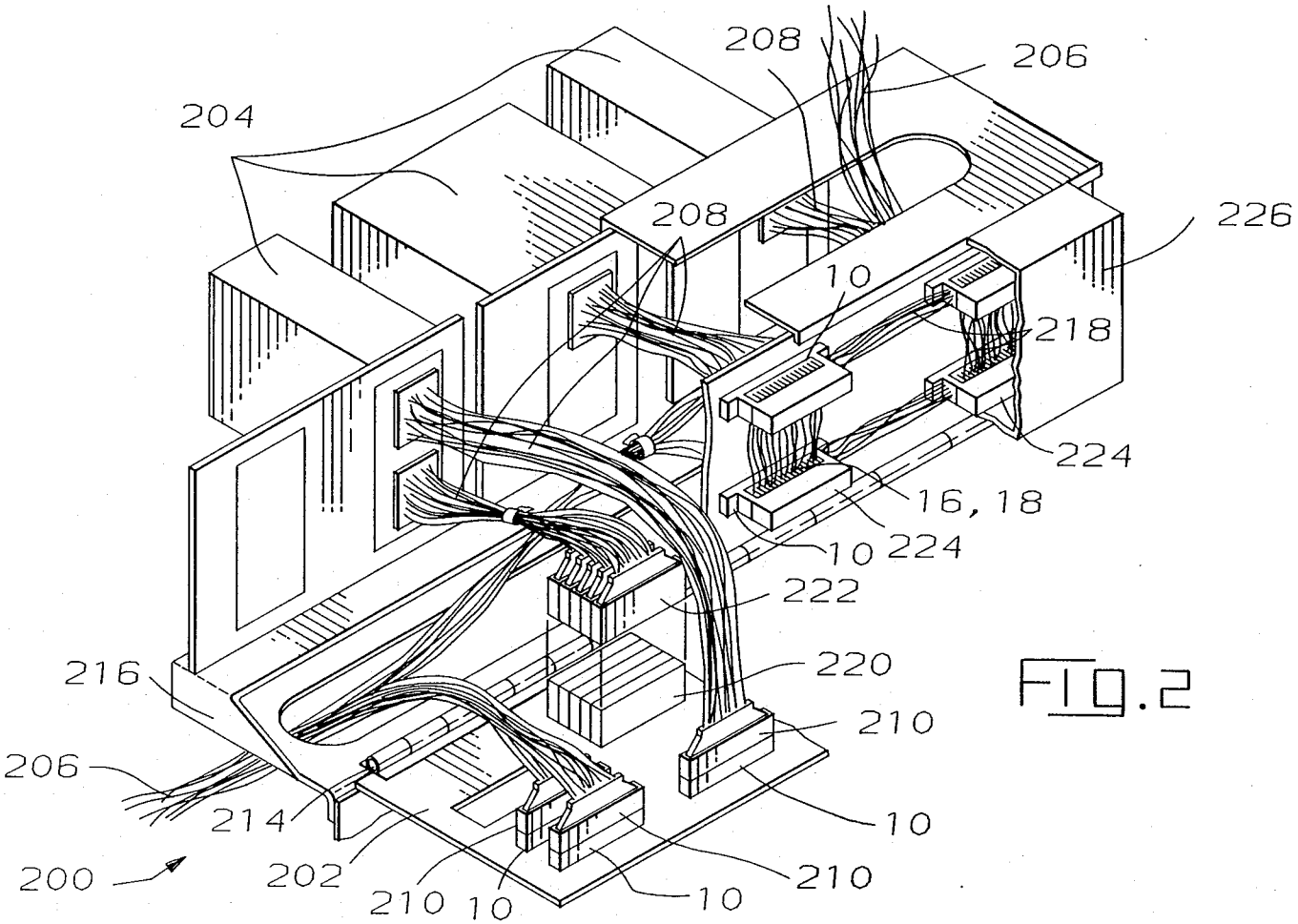

FIGS. 1 and 2 illustrate a wire integration system 200 such as for use on aircraft where a plurality of shipboard systems including power, control, detection, indication, radio reception and transmission and so on must be interconnected or "integrated" at one or more wire integration panels 202 with other such systems. Such systems must be capable of being controlled or sensed at a central location or electrical/electronics bay by a plurality of "black boxes" 204 and also be capable of being interconnected with each other as desired. The black boxes must be capable of removal from the aircraft such as for frequent routine testing and maintenance, or for replacement. Cables 206,208 generally are arranged in bundles or harnesses terminated at one end by modular plug connectors 210 which extend to a wire integration panel 202 on which are mounted receptacle connectors 10 matable at one face of the panel with plug connectors 210. Mating receptacle connectors 10 and plug connectors 210 are shown having two rows of terminals; a receptacle connector 220 and a plug connector 222 are shown ready to be mated and having five rows of terminals, for example, illustrating the modular capability of wire integration system 200.

Along the face of the panel opposed from the face receiving plug connectors 210, in the embodiment shown, terminals 16 of receptacle connectors 10 are secured in housings 12 and have wire wrap posts 18 extending outwardly therefrom for one or more electrical conductor wires 218 to be wrapped for electrical connection to corresponding one or more terminals of respective one or more electrical systems as desired. Preferably post protectors 224 are secured over the wire wrap arrays, and a cover plate 226 is mounted to the panel for additional protection.

The other ends of cables 206 are electrically connected with shipboard systems 212 or another wire integration panel 202, while the other ends of cables 208 are electrically connected to black boxes 204. The mating plug and receptacle connector assemblies 210,10 must be modular and panel mountable; be uniquely keyed; be easily latchable upon mating in an aligned, keyed and polarized manner; and be easily delatchable. Integration panel 202 can have receptacle connectors 10 mounted thereto and automatically or semi-automatically wired as a total subassembly and tested prior to installation into the aircraft, and also can be removed from the aircraft for testing, repair or replacement if necessary. Panel 202 is hinged at hinge 214 to be lowered forwardly from a supporting structure 216 for easy access to the rearward face of the panel. This access facilitates programming and reprogramming which is essential in order to adapt an aircraft of otherwise standard manufacture to meet the avionic requirements of specific customer airlines.

Figure 3:
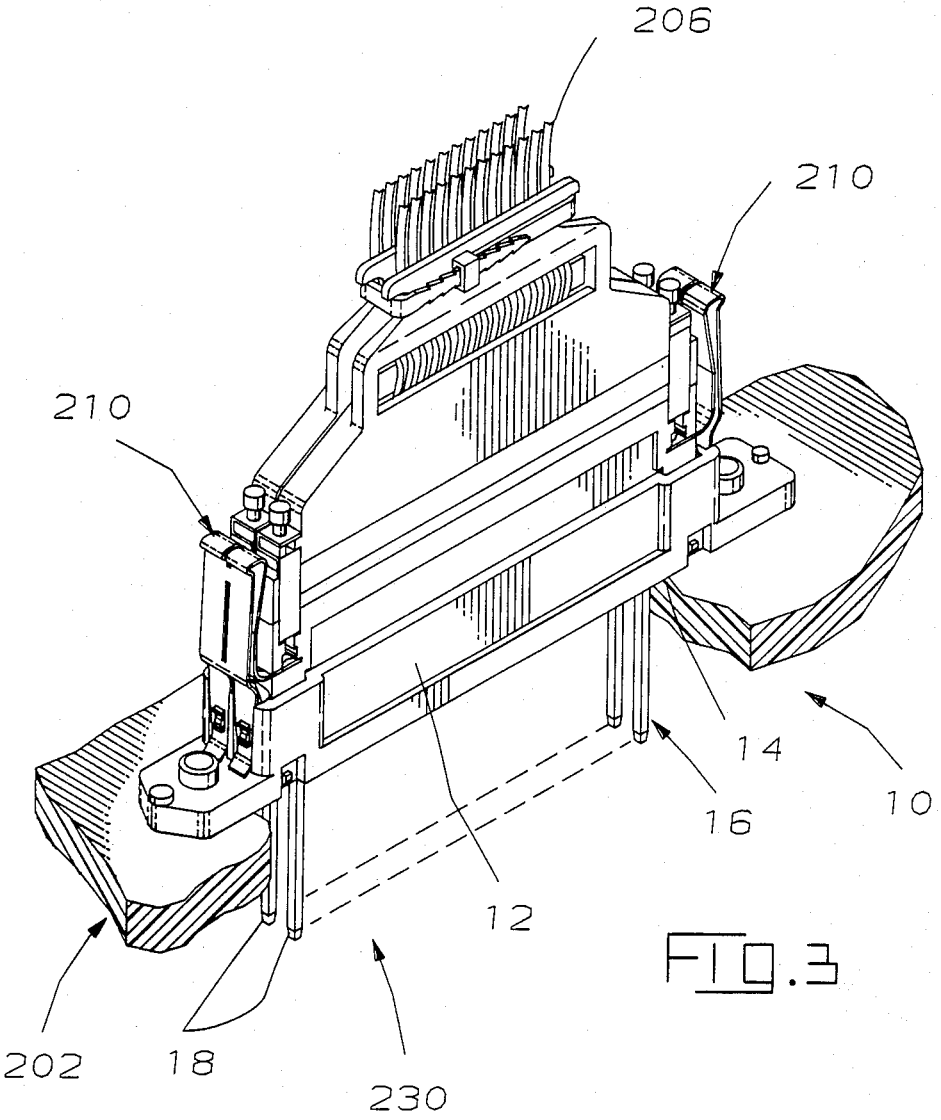
FIG. 3 is a perspective view of mated plug and receptacle connectors for use on a wire integration panel of the system of FIGS. 1 and 2.

FIG. 3 shows a two-row plug connector 210 to mate with the mating face of a two-row receptacle connector 10 mounted to integration panel 202 of FIG. 2, with an array of wire wrap posts 18 of terminals 16 extending from a wire wrap face 14 of the receptacle connector 10. Such a mating connector system 230 for the wire integration system 200 of FIGS. 1 and 2 is described with more particularity in U.S. Pat. Nos. 4,778,411; 4,735,583; 4,804,342; 4,726,791; and 4,752,248, all filed Apr. 24, 1987 and all assigned to the assignee hereof.

Figure 4:
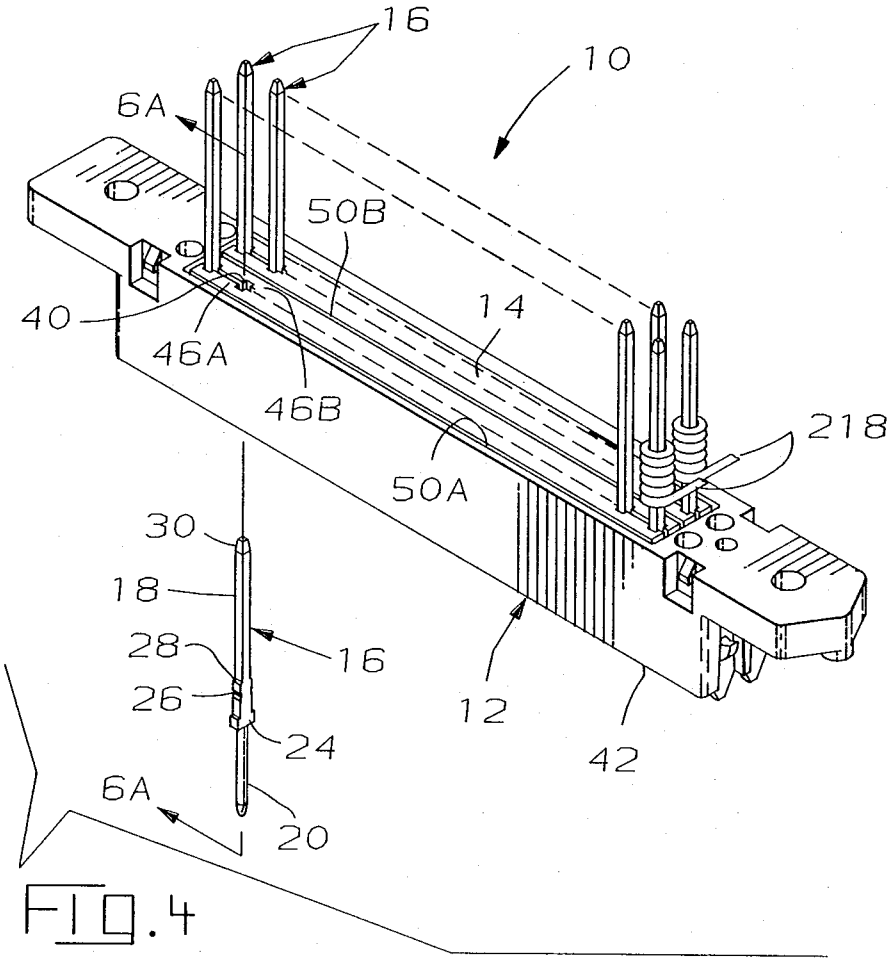
FIG. 4 is a perspective view of a receptacle connector housing with an array of terminals having wire wrap posts extending from a wire warp face of the housing, with one terminal exploded from the mating face.

In FIG. 4, a receptacle connector 10 comprises dielectric housing 12 having a wire wrap face 14, with an array of contact terminals 16 having wire wrap post sections 18 extending outwardly from wire wrap face 14. Terminals 16 are shown to have pin contact sections 20 at their other ends which are matable with socket terminals (not shown) of a mating plug connector 210 of FIG. 3. Representative electrical conductor wires 218 are shown already wrapped around a wire wrap post 18 for in-service use of connector 10, although wire wrapping is performed after mounting of connector 10 to panel 202 by conventional methods and apparatus (not shown).

Figure 5:
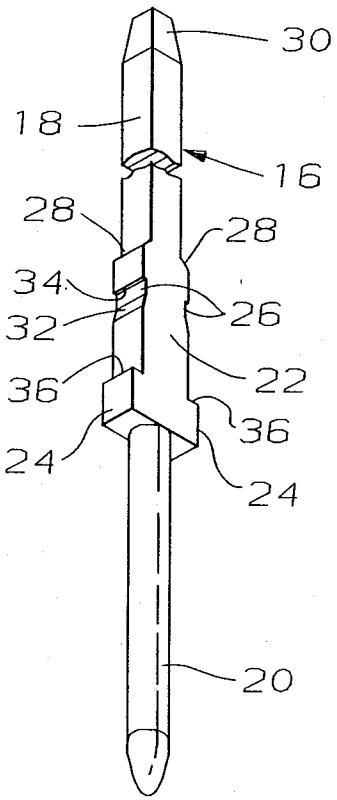
FIG. 5 is a perspective view with which a terminal of the present invention is used.

Referring to FIG. 5, terminal 16 includes a body section 22 having large stop shoulders 24 on opposed first and third sides thereof proximate the base of pin contact section 20, notches 26 also on opposed first and third sides proximate the base of wire wrap post section 18, tapered transition surfaces 28 at the base of post section 18 again on the first and third sides, and a tapered blunt end 30 formed at the end of post section 18. Notches 26 include gradually tapered surfaces 32 leading to stop surfaces 34 facing stop shoulders 24, while stop shoulders 24 define large stop surfaces 36 facing notches 26. Body section 22 is disposed in a plane, inclusive of stop shoulders 24, notches 26, and transition surfaces 28 which can be stamped by die means (not shown) and terminal 16 can be stamped in carrier strip form. Pin contact section 20 can be cold formed or screw machined into a rounded circumference, wire wrap post section 18 can be stamped into a square cross-section and tapered blunt end 30 can be swaged to achieve its shape. The end of post 18 can remain connected to a first carrier strip (not shown) for handling prior to insertion into a housing as can large shoulders 24 which actually comprise part of parallel second carrier strip (not shown) until severing. Such a terminal 16 can preferably be stamped from metal stock 0.045 inches thick and post 18 can be 0.045 inches square. A bipartite strip stock can be used with body section 22 and post 18 comprised of beryllium copper alloy, while pin contact section can be of for example high Strength Modified Copper Alloy HNS C 19400 to facilitate cold forming, and the two metal strips can be welded at overlapped carrier strips extending through large shoulders 24. Posts 18 can be tin-plated and pin contact sections 20 can be selectively gold plated. Terminals for a connector to be mounted to a printed circuit board can have contact sections having a pin shape, appropriate for soldering to conductive paths of a printed circuit board after being inserted through holes thereof, rather than wire wrap posts.

Figure 6A:
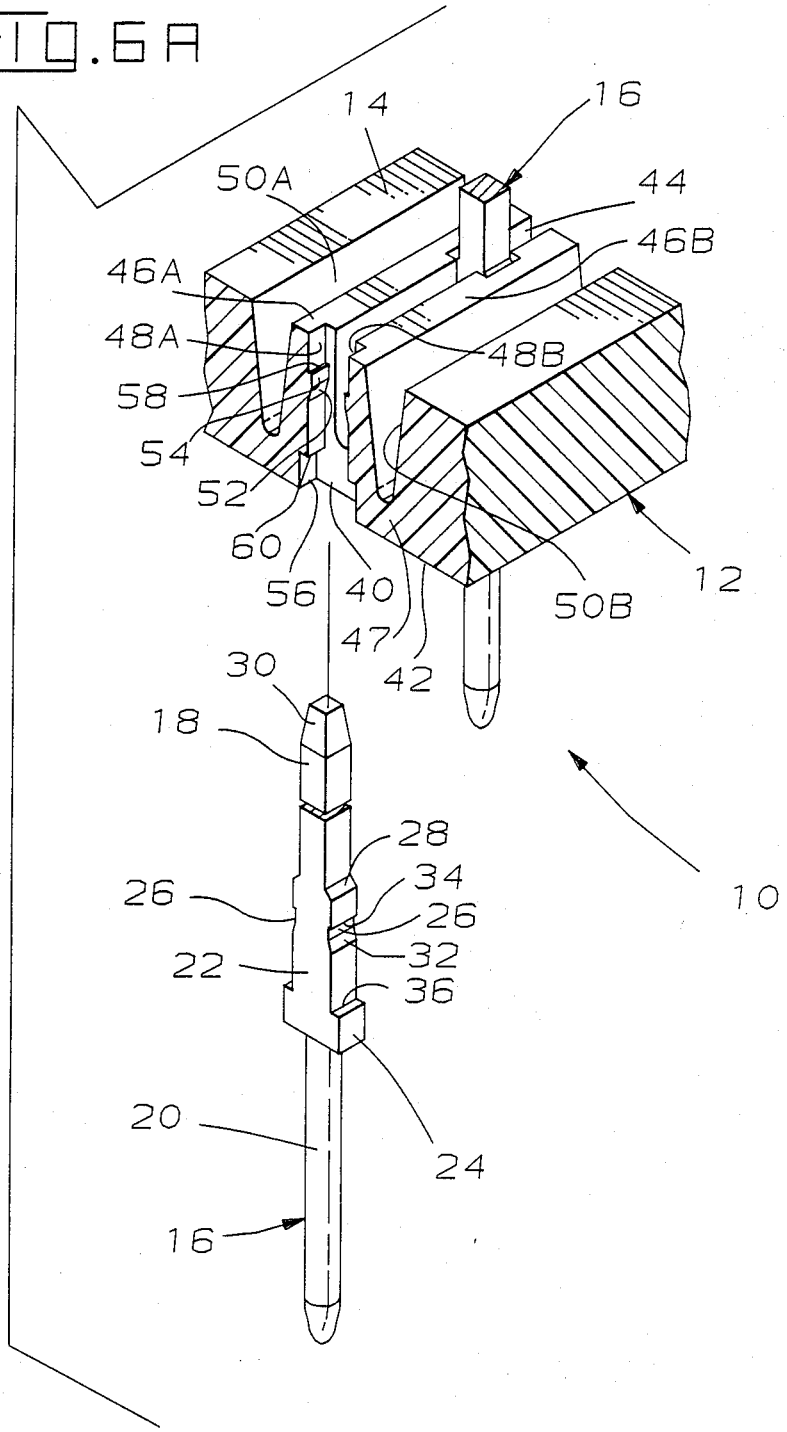
FIGS. 6A, 6B and 6C are part longitudinal section views of the terminal of FIG. 5 being inserted and then retained in a respective passageway of the housing, with FIG. 6A taken through lines 6A—6A of FIG. 4.
Figure 6B:
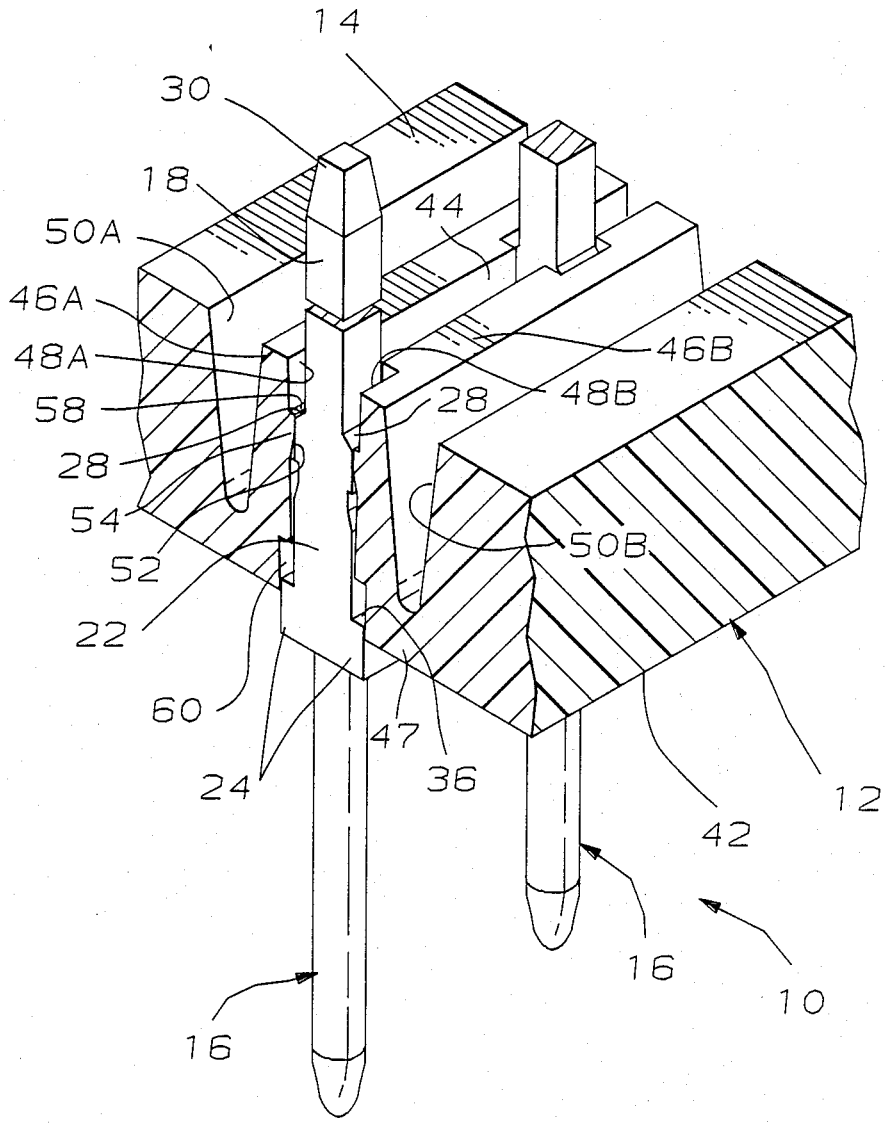
Figure 6C:
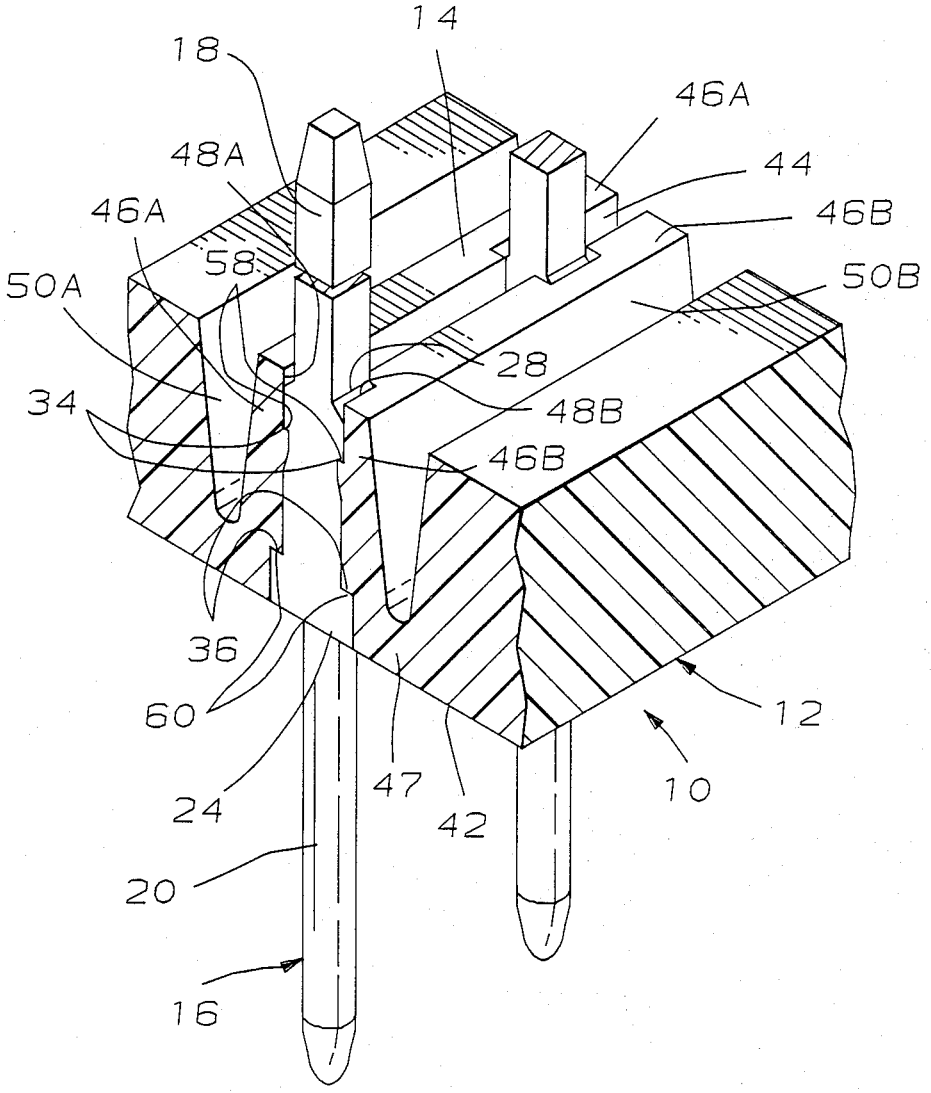

Referring to FIGS. 4 and 6A, housing 12 is moldable from thermoplastic resin such as polyethylene terephthalate with glass fibers for resistance to temperature extremes. Passageways 40 extend from rearward or mating face 42 to forward or wire wrap face 14 and are aligned in rows, and along wire wrap face 14 the passageways of each row are intersected by a deep channel 44. Each deep channel 44 is defined by opposing inside surfaces of a pair of parallel resilient walls 46A, 46B extending from a transverse base portion 47 of housing 12 along rearward face 42 toward forward face 14, each wall preferably having a thicker base and a tapered thinner upper portion. Main portions of passageways 40 are axially short compared to the length of a terminal 16, while forward ends of passageways 40 are comprised of pairs of opposed vertical recesses 48A,48B in which most of each terminal body section 22 will be secured. Between walls 46A,46B of adjacent rows of passageways are parallel deep relief channels 50A,50B. During terminal insertion, terminal 16 is oriented so that the first and third sides will be adjacent walls 46A,46B, and wire wrap post section 18 of terminal 16 is inserted from mating face 42 and extends through passageway 40 and along vertical recesses 48A,48B until tapered transition surfaces 28 engage correspondingly tapered surfaces 52 of paired stop projections 54 extending toward the center of the passageway from walls 46A,46B within vertical recesses 48A,48B. In FIG. 6B, further insertion of terminal 16 through housing 12 causes tapered terminal surfaces 28 to push laterally outwardly against tapered stop projection surfaces 52 and locally deflect upper portions of resilient walls 46A,48A laterally outwardly into relief channels 50A,50B and orthogonally with respect to deep channels 44. Simultaneously, stop shoulders 24 enter a slot-like narrow stop recess 56 of passageway 40 along mating face 42. As forwardly facing stop surfaces 58 of projections 54 pass rearwardly facing terminal stop surfaces 34 defined by notches 26, stop projections 54 will enter notches 26 and walls 46A,46B will return to their normal undeflected position engaging terminal 16, as shown in Figure 6C, resulting in stopping engagement against axially rearward terminal movement. Stop projections 54 also preferably are dimensioned relative to notches 26 to grip terminal 16 for firm retention which maintains the terminal axially aligned. Large stop surfaces 36 of stop shoulders 24 will stoppingly engage rearwardly facing bottom surface portions 60 of stop recess 56 to prevent further axially forward terminal movement. Stop shoulders 24 will be disposed against sides of recess 56 to prevent any rotation of terminal 16 after insertion such as would be caused by torque induced by the wire wrapping process. Terminal 16 is now securely retained in passageway 40 of housing 12 ready for wire to be wrapped around post section 18 and mating engagement by a socket terminal 220 of a mating plug connector 210.

In FIGS. 7, 8 and 9 a removal tool 70 is shown comprising forward and rearward manual gripping sections 72,74 axially movable to a limited extent with respect to each other. Forward gripping section 72 is secured such as by force-fit or bonding about a rear shaft section 76 of main or first section 78, while rearward gripping section 74 is similarly secured to a rear shaft section 80 of plunger or second section 82. Front shaft section 84 of plunger section 82 is disposed within a bore 86 of rear shaft section 76 of main tool section 78 and slidable therealong, while plunger section 82 is secured to main section 78 by means of plunger pin 88 inserted into front bore 90 of main section 78 and force fit into small bore 92 in front shaft section 84 of plunger section 82. Plunger pin 88 has an enlarged forward head 94 disposed in front of annular stop shoulder 96 within front bore 90 of main section 78 (FIG. 9). Front bore 90 is dimensioned to receive a square wire wrap post section 18 of a terminal 16 completely thereinto.

Figure 10A:
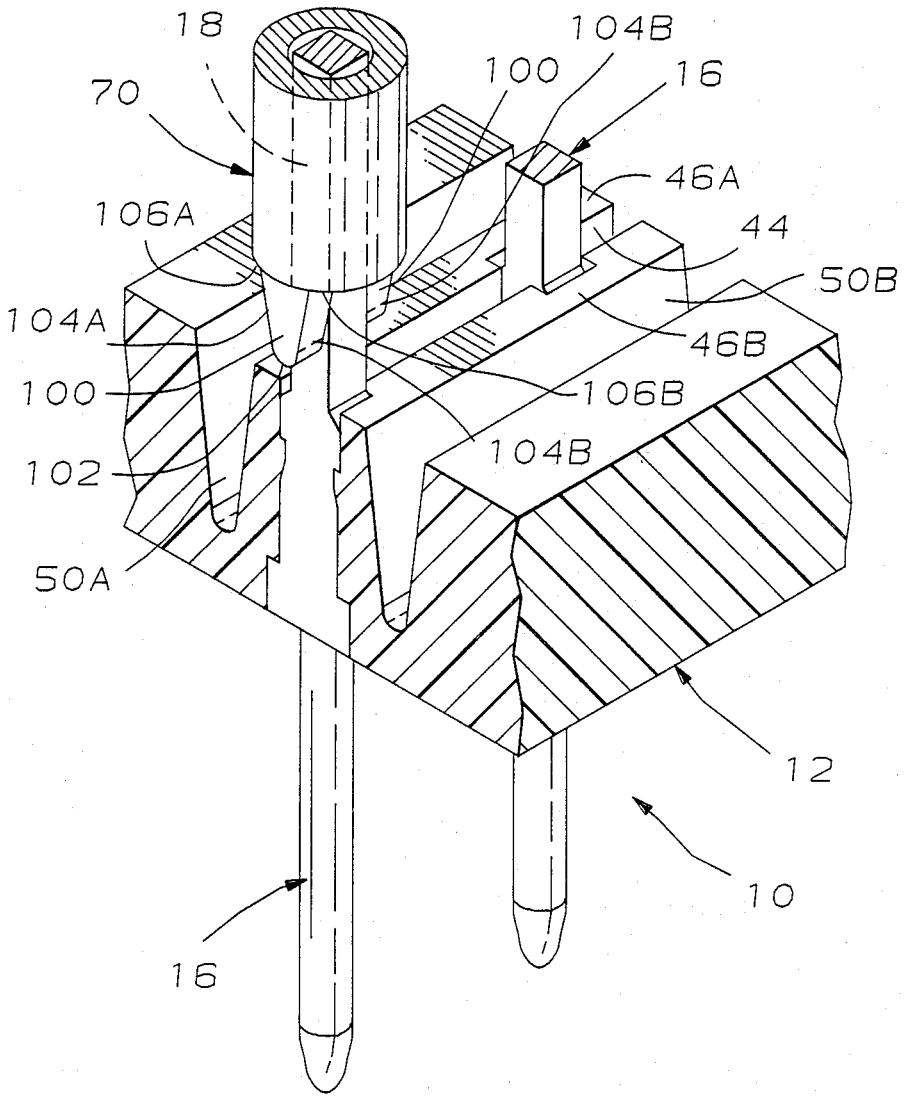

Referring now to FIGS. 10A and 10B, at the forward or work end of front shaft section 98 of main tool section 78 are a pair of opposed tines 100 spaced apart to straddle a wire wrap post section 18 along second and fourth sides thereof when tool 70 is inserted thereover, and each tine 100 is shaped to enter channel 44 beside vertical recesses 48A,48B. Each tine has a rounded end 102 forwardly of wall-engaging surfaces 104A,104B which are preferably tapered outwardly at an angle of about 8°. Tine stop surfaces 106A,106B are located to stop insertion of tines 100 into channel 44 at the point at which walls 46A,46B have been deflected outwardly enough by wall-engaging surfaces 104A,104B to prevent overinsertion and overstress of resilient walls 46A,46B, with the angle of taper of wall-engaging surfaces 104A,104B also selected to minimize overstress of walls 46A,46B. In FIGS. 10B and 11 full tine insertion has been achieved and sufficient local wall deflection accomplished to release stop projections 54 from terminal notches 26 and permit withdrawal of terminal 16 from passageway 40 of housing 12.

When walls 46A,46B are deflected as in FIG. 11, the plunger section of tool 70 is actuated by rearward gripping section 74 being pushed toward forward gripping section 72. As illustrated in FIGS. 12A and 12B, this actuation moves plunger section 82 axially forwardly and urges the flat end of plunger pin 88 against terminal post end 30 which pushes terminal 16 rearwardly along passageway 40 a sufficient distance to move notches 26 away from stop projections 54. Terminal 16 can then be fully removed from passageway 40 by pulling on pin contact section 20 or large shoulders 24 since no stop surfaces now will engage to prevent axially rearward movement.

The contact retention system thus remains intact to permit insertion of a new like terminal 16 into passageway 40 vacated by the removed terminal. The contact retention system of the present invention can be utilized in other connector systems than the one described herein, and modifications may occur thereto which are within the spirit of the invention and the scope of the claims.

What is claimed is:

1. A tool for removing a terminal from between stop sections of opposed continuous parallell walls along a housing face, said terminal including a contact section extending outwardly from said housing face, comprising:

a first section including a forward shaft portion extending to a work end, said first section further including a rearward shaft portion including a first gripping means, a profiled bore having forward and rearward bore portions extending through said forward and rearward shaft portions respectively; and a second section secured to and slidably movable axially with respect to said first section and including a second gripping means spaced axially rearwardly from said first gripping means, said second section including a plunger shaft extending forwardly within at least said rearward bore portion to a plunger end disposed within said forward bore portion spaced rearwardly from said work end, said plunger end being axially movable from a first position forwardly to a second position within said forward bore portion when said second section is movable from a first position forwardly to a second position with respect to said first section;

said forward bore portion receiving a contact section of a terminal thereinto from said work end when the tool is placed in position for terminal removal, said work end deflecting laterally outwardly sections of housing walls beside said contact section by movement toward said housing face to move said stop sections of said walls out of stopping engagement with said terminal, and said plunger end engaging an end of said contact section when said work end has locally deflected said walls and said second section is urged from said first position to said second position, whereby said terminal is moved a selected distance axially rearwardly with respect to said housing face and out of stopping engagement by said stop sections for removal from said housing.

2. A tool as set forth in claim 1 wherein said work end comprises a spaced pair of tines on opposite sides of said forward bore portion each including tapered forwardly facing opposed side surfaces, said side surfaces on respective first sides and on respective second sides being substantially coplanar to simultaneously engage closely spaced resilient walls of said housing and locally deflect laterally outwardly engaged portions thereof.

3. A tool as set forth in claim 1 wherein said plunger shaft includes a small bore extending thereinto from a forward end thereof, and said second section further including a plunger pin force-fitted into said small bore after being inserted into said forward bore portion of said first section, said plunger pin having an enlarged forward end defining a rearwardly facing annular stop cooperable with a forwardly facing annular shoulder along said profiled bore of said first section to stop rearward axial movement of said second section with respect to said first section, and said plunger pin forward end comprising said plunger end.

* * * * *

UNITED STATES PATENT OFFICE

CERTIFICATE OF CORRECTION

Patent No. 4,864,719 Dated September 12, 1989

Inventor(s) William J. Rudy Jr., Howard R. Shaffer and Daniel E. Stahl

It is certified that error appears in the above-identified patent and that said Letters Patent is hereby corrected as shown below:

Title page:

In the Abstract:

Sixth line from the bottom, "(46Ar,46B)" should be "(46A,46B)".

Last line, add --section (82)-- after the word "plunger".

Signed and Sealed this

Seventh Day of August, 1990

*Attest:*

HARRY F. MANBECK, JR.

*Attesting Officer*

*Commissioner of Patents and Trademarks*